US009257771B2

(12) United States Patent
Yasui et al.

(10) Patent No.: US 9,257,771 B2
(45) Date of Patent: Feb. 9, 2016

(54) CARD CONNECTOR AND ELECTRONIC APPARATUS

(71) Applicant: Kabushiki Kaisha Toshiba, Tokyo (JP)

(72) Inventors: Satoru Yasui, Kokubunji (JP); Takahiro Sakaguchi, Ome (JP); Kei Akiyama, Tachikawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/459,082

(22) Filed: Aug. 13, 2014

(65) Prior Publication Data

US 2015/0171534 A1 Jun. 18, 2015

Related U.S. Application Data

(60) Provisional application No. 61/917,159, filed on Dec. 17, 2013.

(51) Int. Cl.

| | |
|---|---|
| ***H01R 24/00*** | (2011.01) |
| ***H01R 13/24*** | (2006.01) |
| ***H01R 12/72*** | (2011.01) |

(52) U.S. Cl.

CPC ..... *H01R 13/2442* (2013.01); *H01R 12/722* (2013.01)

(58) Field of Classification Search

CPC .. H01R 13/635; H01R 31/06; H01R 23/7068; G06K 13/0806

USPC ..... 439/152, 188, 630, 64, 159, 946

See application file for complete search history.

(56) References Cited

U.S. PATENT DOCUMENTS

| | | | | |
|---|---|---|---|---|
| 7,452,241 | B2 * | 11/2008 | Kikuchi et al. | 439/630 |
| 7,453,692 | B2 * | 11/2008 | Chen | 361/679.33 |
| 7,455,555 | B1 * | 11/2008 | Lai | 439/630 |
| 7,611,056 | B2 * | 11/2009 | Sato | 235/441 |

FOREIGN PATENT DOCUMENTS

| | | |
|---|---|---|
| JP | 10-111915 | 4/1998 |
| JP | 2002-141123 | 5/2002 |
| JP | 2013-012433 | 1/2013 |

* cited by examiner

*Primary Examiner* — Neil Abrams
*Assistant Examiner* — Travis Chambers
(74) *Attorney, Agent, or Firm* — Rutan & Tucker LLP; William W. Schaal

(57) ABSTRACT

According to one embodiment, a card connector in which a card-shaped storage medium having card terminals is inserted so as to be extracted includes connector terminals configured to contact the card terminals and a terminal protecting member. The terminal protecting member includes a coated portion configured to maintain the connector terminals in a state of being in no contact with the card-shaped storage medium while the card-shaped storage medium is inserted in the card housing module up to contact positions where the card terminals contact the connector terminals.

16 Claims, 5 Drawing Sheets

CARD CONNECTOR AND ELECTRONIC APPARATUS

CROSS-REFERENCE TO RELATED APPLICATIONS

This application claims the benefit of U.S. Provisional Application No. 61/917,159, filed Dec. 17, 2013, the entire contents of which are incorporated herein by reference.

FIELD

Embodiments described herein relate generally to a card connector and electronic apparatus.

BACKGROUND

In electronic apparatuses such as digital cameras, smartphones and cellphones, for example, card-shaped storage media such as SD cards are used as data storage media. The card-shaped storage media are configured to be inserted into or extracted from card connectors provided at the electronic apparatuses.

When a card-shaped storage medium is inserted into a card connector, a plurality of card terminals provided on the card-shaped storage medium are brought into contact with a plurality of connector terminals provided at the card connector.

Incidentally, according to the card-shaped storage medium, each card terminal is provided in a position recessed from a surface of the card-shaped storage medium. In other words, a stepped wall is formed at a boundary portion between each card terminal and the surface of the card type storage medium.

For this reason, when the card-shaped storage medium is inserted in or extracted from the card connector, each connector terminal often abuts on or engages with the stepped wall. As a result, each connector terminal may be bent or buckled.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings. In general, according to one embodiment, a card connector in which a card-shaped storage medium having card terminals arranged in positions recessed from a surface is inserted so as to be extracted, includes connector terminals provided in a card housing module and configured to contact the card terminals of the card-shaped storage medium and a terminal protecting member configured to move between the card-shaped storage medium and the connector terminals in accordance with operations of inserting and extracting the card-shaped storage medium. The terminal protecting member includes a coated portion configured to maintain the connector terminals in a state of being in no contact with the card-shaped storage medium while the card-shaped storage medium is inserted in the card housing module up to contact positions where the card terminals contact the connector terminals. The coated portion includes through holes which intervene between the connector terminals and the card terminals and urge the connector terminals to contact the card terminals when the card-shaped storage medium is inserted in the contact positions of the card housing module.

The embodiment will be described hereinafter with reference to the accompanying drawings.

Figure 1A:
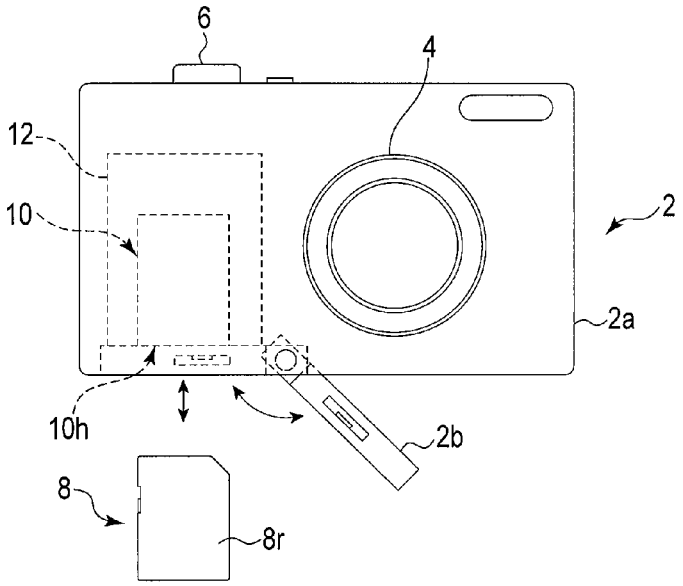
FIG. 1A is an exemplary front view showing a camera of an embodiment seen from a photographing lens.

FIG. 1A shows a camera 2 as an example of an electronic apparatus. In a housing 2*a* (hereinafter called a camera body) of the camera 2, for example, a photographing lens 4 and a shutter button 6 are provided besides a shutter, an image pickup element, an optical finder, etc. (not shown).

When the shutter button 6 is fully pressed, the shutter is opened. At this time, light passing through the photographing lens 4 strikes the image pickup element and a subject image is captured through an optical finder.

A card connector 10 which allows a card-shaped storage medium 8 such as an SD card to be inserted therein or extracted therefrom as a data storage medium is built in the camera body 2*a*.

Figure 2:
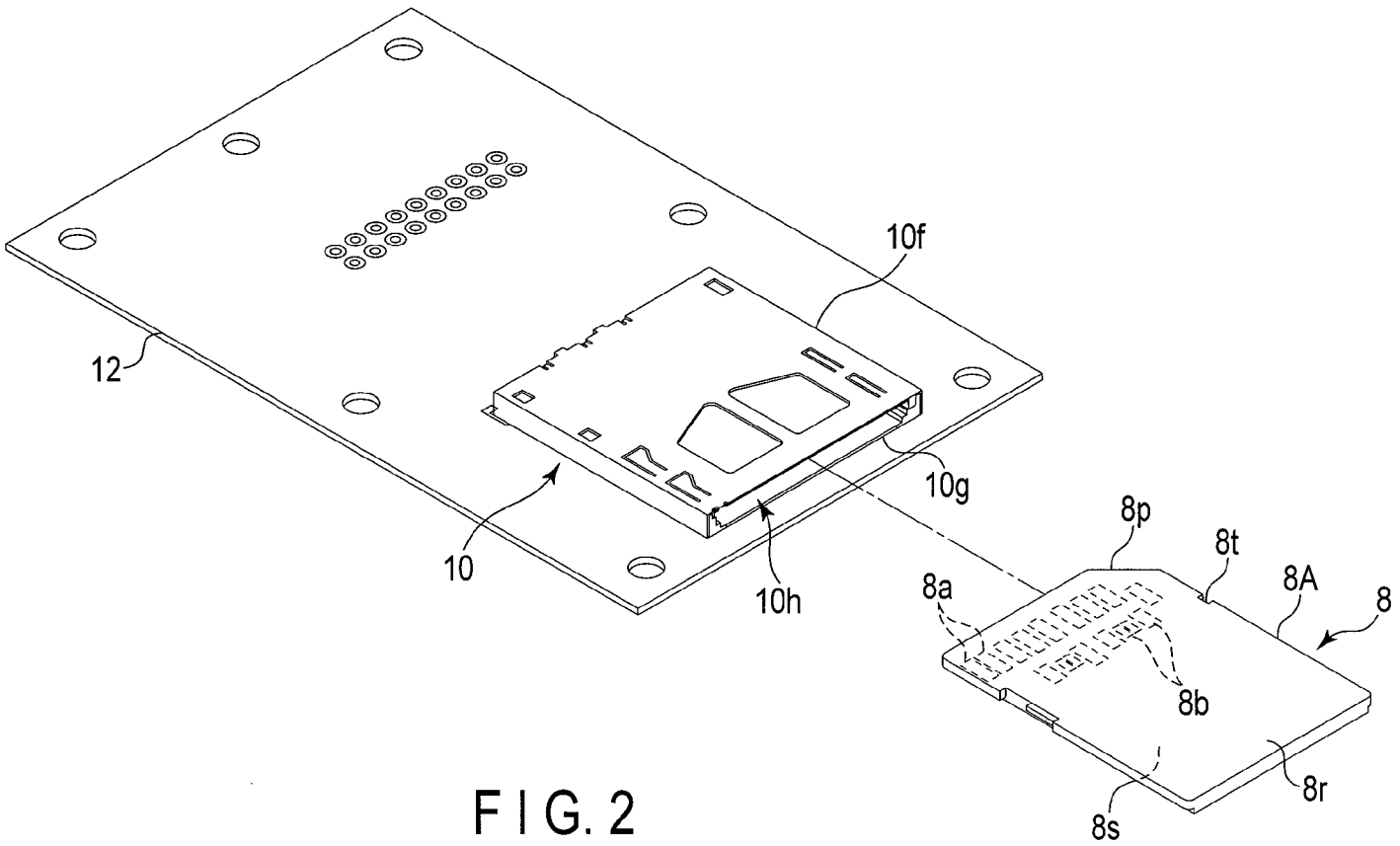
FIG. 2 is an exemplary perspective view showing an appearance of a card connector of the embodiment.

The card connector 10 is mounted on a board 12 formed of an insulator on which a wiring pattern (not shown) is printed, and comprises a base 10*g* fixed on the board 12 and a cover 10*f* attached to cover the base 10*g*, as shown in FIG. 2.

A card insertion/extraction opening 10*h* surrounded by the base 10*g* and the cover 10*f* is constituted at one of edge sides of the card connector 10. An opening/closing door 2*b* (see FIG. 1A) is provided on the camera body 2*a*, opposite to the card insertion/extraction opening 10*h*, so as to open and close. The card-shaped storage medium 8 can be inserted in the card connector 10 through the card insertion/extraction opening 10*h* so as to be extracted therefrom, by opening the opening/closing door 2*b*.

Figure 1B:
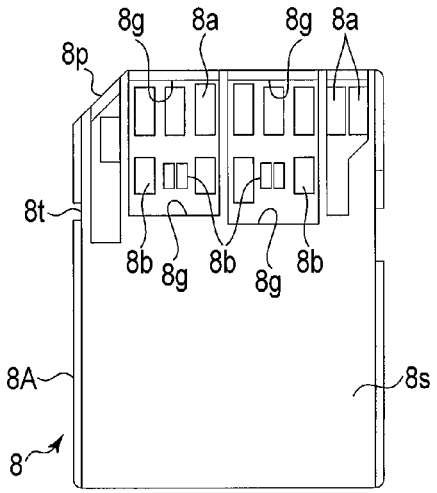
FIG. 1B is an exemplary plan view showing a structure of a card-shaped storage medium applied to the embodiment.
Figure 1C:
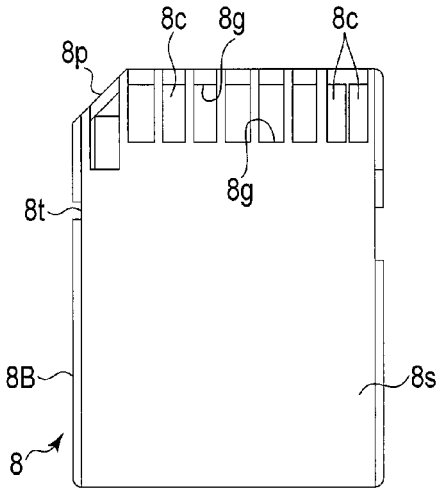
FIG. 1C is an exemplary plan view showing a structure of another card-shaped storage medium applied to the embodiment.

A plural-row-terminal type card-shaped storage medium 8A (see FIG. 1B) having a plurality of card terminals 8*a* and 8*b* aligned in two rows along the inserting/extracting direction or a single-row-terminal type card-shaped storage medium 8B (see FIG. 10) having a plurality of card terminals 8*c* aligned in a single row can be used as the card-shaped storage medium 8.

When the plural-row-terminal type card-shaped storage medium 8A is inserted in the card connector 10, the plurality of card terminals 8*a* and 8*b* (see FIG. 1B) provided on the card-shaped storage medium 8A are brought into contact with a plurality of connector terminals 10*a* and 10*b* (see FIG. 3A and FIG. 3B) provided on the card connector 10, respectively. At this time, the captured subject image data is stored in the card-shaped storage medium 8A by executing data communication between the connector terminals 10*a* and 10*b* and the card terminals 8*a* and 8*b*.

When the single-row-terminal type card-shaped storage medium 8B is inserted in the card connector 10, the plurality of card terminals 8*c* (see FIG. 10) provided on the card-shaped storage medium 8B are brought into contact with the plurality of connector terminals 10*a* (see FIG. 3A and FIG. 3B) provided on the card connector 10. At this time, the captured subject image data is stored in the card-shaped storage medium 8B by executing data communication between the connector terminals 10*a* and the card terminals 8*c*.

Each of the card-shaped storage media 8A and 8B has a surface 8*s* and a back surface 8*r* opposite to the surface 8*s*. Each of the card terminals 8*a* and 8*b* is provided in a position recessed from the surface 8*s* of each of the card-shaped storage media 8A and 8B. An amount of recess (i.e., depth of recess) of the card terminals 8*a* and 8*b* from the surface 8*s* of the card-shaped storage media 8A and 8B is defined to be within a certain range in the technical field of the card-shaped storage media 8A and 8B.

The plural-row-terminal type card-shaped storage medium 8A (see FIG. 1B) will be explained as an example in the following descriptions.

Figure 3A:
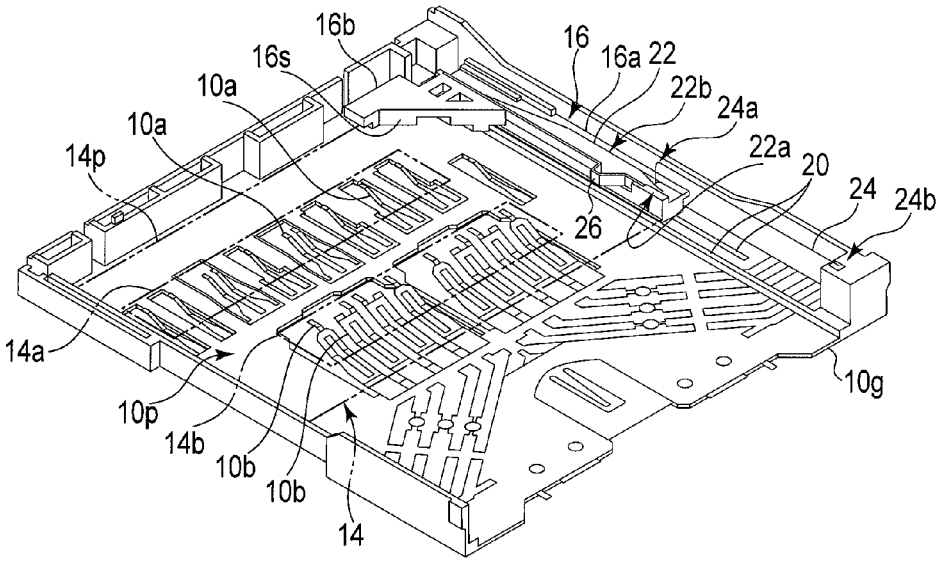
FIG. 3A is an exemplary perspective view showing an inner structure of the card connector of the embodiment in which an eject lever is moved up to a card insertion position.
Figure 3B:
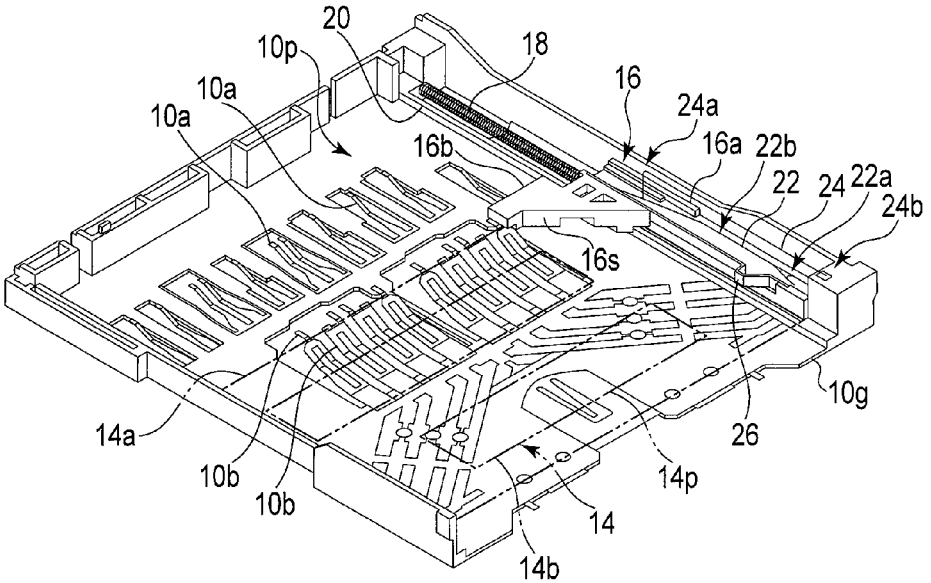
FIG. 3B is an exemplary perspective view showing the inner structure of the card connector of the embodiment in which the eject lever is moved up to a card extraction position.

FIG. 3A and FIG. 3B show an inner structure of the card connector 10 in a state in which the cover 10*f* is detached from the base 10*g*. The card connector 10 comprises a card housing portion 10*p* in which the card-shaped storage medium 8A (hereinafter called plural-row-terminal card) inserted through the card insertion/extraction opening 10*h* is housed.

The plurality of connector terminals 10*a* and 10*b* which are brought into contact with the card terminals 8*a* and 8*b*, respectively, are provided in positions corresponding to the respective card terminals 8*a* and 8*b* of the plural-row-terminal card 8A, in the card housing portion 10*p*.

In other words, nine first card terminals 8*a* are provided at a downstream side of the card inserting direction, on the plural-row-terminal card 8A. The first card terminals 8*a* are aligned across the card inserting direction (see FIG. 1B).

Furthermore, eight second card terminals 8*b* are provided at a more upstream side of the card inserting direction than the first card terminals 8*a*, on the plural-row-terminal card 8A. The second card terminals 8*b* are aligned across the card inserting direction (see FIG. 1B).

On the other hand, nine first connector terminals 10*a* are provided at the card housing portion 10*p* so as to contact nine first card terminals 8*a*, respectively, in a state in which the plural-row-terminal card 8A is housed in the card housing portion 10*p*. The first connector terminals 10*a* are constituted to be in an attitude raised from the base 10*g* of the card connector 10, and elastically contact the first card terminals 8*a*, respectively.

Moreover, eight second connector terminals 10*b* are provided at the card housing portion 10*p* so as to contact eight second card terminals 8*b*, respectively, in a state in which the plural-row-terminal card 8A is housed in the card housing portion 10*p*. The second connector terminals 10*b* are constituted to be in an attitude raised from the base 10*g* of the card connector 10, and elastically contact the second card terminals 8*b*, respectively.

Moreover, in the card housing portion 10*p*, a terminal protecting member 14 configured to move between the plural-row-terminal card 8A and each of the connector terminals 10*a* and 10*b*, in accordance with the operation of inserting or extracting the plural-row-terminal card 8A, and a guide mechanism configured to guide the terminal protecting member 14 along the direction of inserting or extracting the plural-row-terminal card 8A, are provided.

Figure 4A:
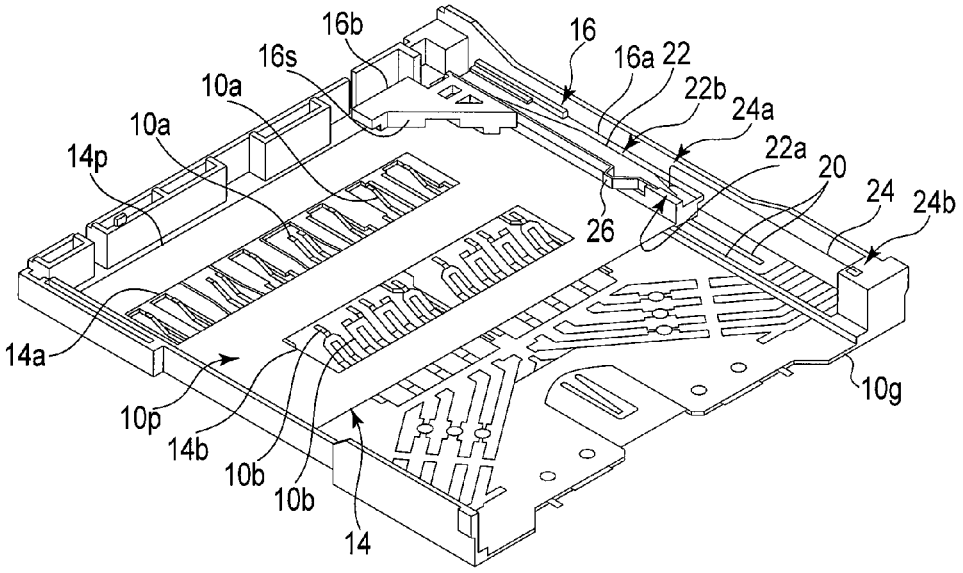
FIG. 4A is an exemplary perspective view showing a structure of a terminal protecting member of the card connector of the embodiment in which the terminal protecting member is moved up to the card insertion position.
Figure 4B:
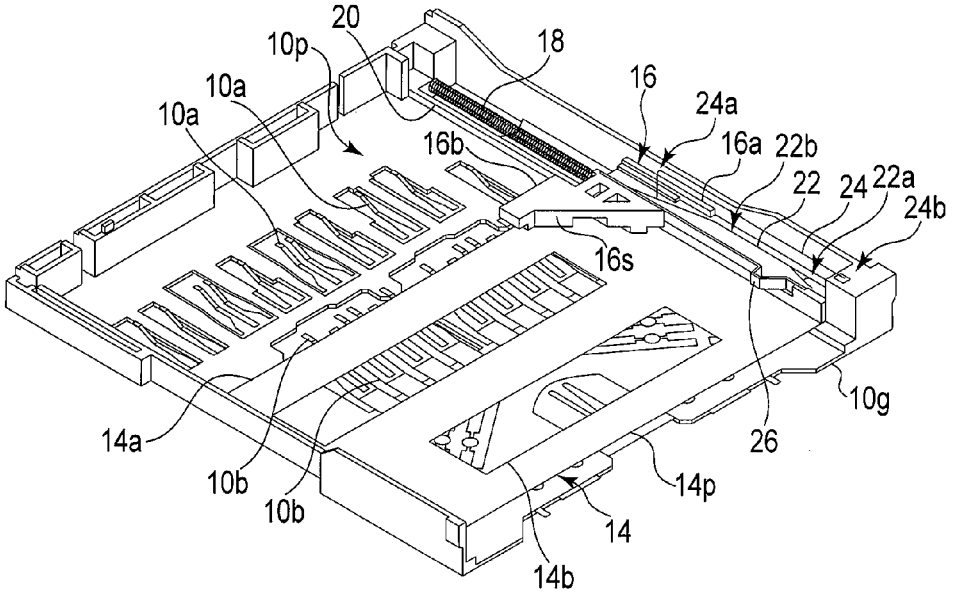
FIG. 4B is an exemplary perspective view showing the structure of the terminal protecting member of the card connector of the embodiment in which the terminal protecting member is moved up to the card extraction position.
Figure 5A:
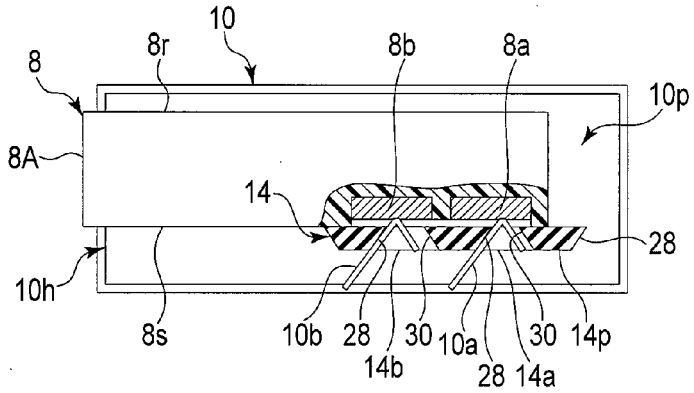
FIG. 5A is an exemplary cross-sectional view schematically showing a state in which a connector terminal is brought into contact with a card terminal through a through hole of the terminal protecting member.

The terminal protecting member 14 is constituted such that the first card terminals 8*a* and the second card terminals 8*b* contact the first connector terminals 10*a* and the second connector terminals 10*b* only when the plural-row-terminal card 8A is housed in the card housing portion 10*p*, as shown in FIG. 4A, FIG. 4B and FIG. 5A.

In other words, the terminal protecting member 14 comprises a coated portion 14*p* constituted to hold the connector terminals 10*a* and 10*b* to be in no contact with the plural-row-terminal card 8A while the plural-row-terminal card 8A is inserted in the card housing portion 10*p* up to the contact position where the card terminals 8*a* and 8*b* contact the connector terminals 10*a* and 10*b*, respectively.

The coated portion 14*p* comprises two through holes 14*a* and 14*b* which intervene between the connector terminals 10*a* and 10*b* and the card terminals 8*a* and 8*b*, respectively, and urge the connector terminals 10*a* and 10*b* to contact the card terminals 8*a* and 8*b* when the plural-row-terminal card 8A is inserted up to the contact position in the card housing portion 10*p*.

In this case, the size and shape of the coated portion 14*p* of the terminal protecting member 14 are not particularly limited here since they are set in accordance with the size and shape of the card housing portion 10*p*. The size and shape of each of the through holes 14*a* and 14*b* formed on the coated portion 14*p* are not particularly limited here since they are set in accordance with the number, size and shape of each of the connector terminals 10*a* and 10*b* and each of the card terminals 8*a* and 8*b*.

In the present embodiment, the size and shape of the through hole 14*a* are set by considering the arrangement of each first card terminal 8*a* and each first connector terminal 10*a* in the contact position, and the size and shape of the through hole 14*b* are set by considering the arrangement of each second card terminal 8*b* and each second connector terminal 10*b* in the contact position.

The figures show the terminal protecting member 14 comprising the rectangular coated portion 14*p*, and the rectangular through holes 14*a* and 14*b* aligned in two rows along the inserting and extracting direction, as an example. The connector terminals 10*a* and 10*b* thereby become able to contact the card terminals 8*a* and 8*b* through the through holes 14*a* and 14*b*, respectively, only when the plural-row-terminal card 8A is inserted up to the contact position in the card housing portion 10*p*.

In the present embodiment, the guide mechanism is configured by employing a push/push-type ejection mechanism provided at the card connector 10 as it is. In other words, the guide mechanism comprises an eject lever 16 which is movable along the inserting and extracting direction of the plural-row-terminal card 8A and an urging member 18 (for example, compression coil spring) configured to urge the eject lever 16 in the extracting direction at any time.

The eject lever 16 comprises a slider portion 16*a* extending along the inserting and extracting direction of the plural-row-terminal card 8A and an eject portion 16*b* provided at a tip side of the slider portion 16*a*.

The slider portion 16*a* is configured to be movable along paired guide rails 20 provided in positions avoiding the card housing portion 10*p*. The paired guide rails 20 extend parallel to each other along the inserting and extracting direction of the plural-row-terminal card 8A.

The eject portion 16*b* is shaped to project from the slider portion 16*a* toward the card housing portion 10*p*, and comprises an abutting plane 16*s* which abuts on a cutaway portion 8*p* (see FIG. 1B and FIG. 2) at an insertion tip side of the plural-row-terminal card 8A.

The urging member 18 (compression coil spring) is inserted between the tip of the slider portion 16*a* and the base 10*g* so as to be compressible and deformable, and applies the urging force (pressurizing force) to the slider portion 16*a* at any time.

In this case, the eject portion 16*b* abuts on the cutaway portion 8*p* of the plural-row-terminal card 8A at any time during the insertion of the plural-row-terminal card 8A in the card housing portion 10*p* and the extraction of the plural-row-terminal card 8A from the card housing portion 10*p*. The operations of inserting and extracting the plural-row-terminal card 8A are thereby transmitted to the slider portion 16*a* via the eject portion 16*b* and urge the slider portion 16*a* to move along the paired guide rails 20. As a result, the eject lever 16 becomes movable in accordance with the operations of inserting the plural-row-terminal card 8A in the card housing portion 10*p* and extracting the plural-row-terminal card 8A from the card housing portion 10*p*.

A heart-cam mechanism is provided at the slider portion 16*a*. The heart-cam mechanism comprises a heart-cam groove 22 formed on a surface of the slider portion 16*a* and a pin member 24 guided along the heart-cam groove 22.

The heart-cam groove 22 comprises a cam groove portion 22*a* bent in a heart shape and a long groove portion 22*b* formed to unify from both sides of the cam groove portion 22*a* toward a tip side of the slider portion 16*a*. The pin member 24 has a free end 24*a* engaged with the heart-cam groove 22 and has a fixed end 24*b* supported on the base 10*g* to be freely rotatable.

If the plural-row-terminal card 8A is pushed from the card insertion/extraction opening 10*h* into the card housing portion 10*p*, the eject lever 16 moves against the urging force of the urging member 18 in accordance with the operation of pushing the plural-row-terminal card 8A. When the free end 24*a* of the pin member 24 is guided from the long groove portion 22*b* to the cam groove portion 22*a* and engages with the cam groove portion 22*a*, the urging force of the urging member 18 is supported by the pin member 24. The plural-row-terminal card 8A can be thereby housed in the card housing portion 10*p*. At this time, an engagement element 26 provided on the slider portion 16*a* engages with a recess portion 8*t* (see FIG. 1B and FIG. 2) of the plural-row-terminal card 8A. As a result, the plural-row-terminal card 8A cannot be extracted from the card housing portion 10*p*.

In this state, if the plural-row-terminal card 8A is pushed into the card housing portion 10*p* again, the engagement of the engagement element 26 with the recess portion 8*t* of the plural-row-terminal card 8A is canceled and the engagement of the free end 24*a* of the pin member 24 with the cam groove portion 22*a* is canceled. At this time, the eject lever 16 is pushed back by the urging force of the urging member 18. The plural-row-terminal card 8A can be thereby ejected from the card housing portion 10*p*.

In the present embodiment, the terminal protecting member 14 is integrated with the eject lever 16. As the integrating method, a method of retrofitting the terminal protecting member 14 to the eject lever 16 by, for example, bonding, screwing, etc., a method of integrating the terminal protecting member 14 with the eject lever 16, etc. can be applied.

In the integration, when the plural-row-terminal card 8A is housed in the card housing portion 10*p* (see FIG. 5A), the terminal protecting member 14 is positioned in view of the eject lever 16 such that the card terminals 8*a* and 8*b* are in contact with the connector terminals 10*a* and 10*b* through the through holes 14*a* and 14*b* of the coated portion 14*p*, respectively.

Figure 5B:
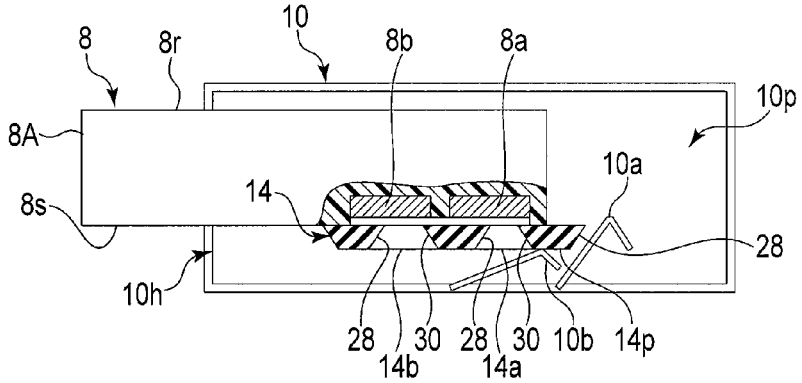
FIG. 5B is an exemplary cross-sectional view schematically showing a state in which the terminal protecting member is moved in accordance with a card inserting or extracting operation.
Figure 5C:
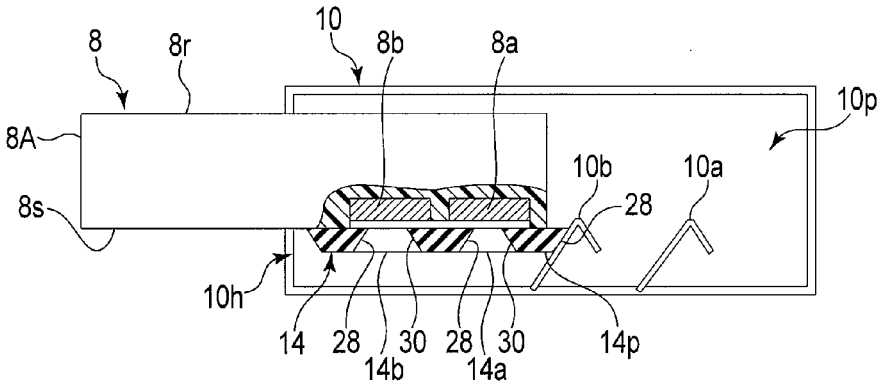
FIG. 5C is an exemplary cross-sectional view schematically showing a state in which the terminal protecting member is located in a card insertion or extraction position.

A first inclined plane 28 is formed at the tip side of the terminal protecting member 14 in the inserting direction as shown in FIGS. 5A to 5C. A first inclined plane 28 and a second inclined plane 30 are formed to be opposite to each other, in each of the through holes 14*a* and 14*b* of the terminal protecting member 14. The first inclined plane 28 is positioned at a more upstream side in the inserting direction than the second inclined plane 30, in each of the through holes 14*a* and 14*b*.

When the plural-row-terminal card 8A is inserted, the first inclined planes 28 guide the connector terminals 10*a* and 10*b* in a direction of moving away from the plural-row-terminal card 8A and urge the connector terminals 10*a* and 10*b* to retreat to the coated portion 14*p*. At the insertion of the plural-row-terminal card 8A, the second inclined planes 30 guide the connector terminals 10*a* and 10*b* urged to retreat to the coated portion 14*p*, toward the plural-row-terminal card 8A. Furthermore, when the plural-row-terminal card 8A is extracted, the second inclined planes 30 guide the connector terminals 10*a* and 10*b* in the direction of moving away from the plural-row-terminal card 8A and urge the connector terminals 10*a* and 10*b* to retreat to the coated portion 14*p*.

An angle of inclination of the first inclined planes 28 and the second inclined planes 30 can be set, based on the arrangement of the connector terminals 10*a* and 10*b*. In the present embodiment, since the connector terminals 10*a* and 10*b* are constituted to be in an attitude raised from the base 10*g* of the card connector 10, the angle of inclination can be set, based on, for example, outlines, gradients, etc. of the connector terminals. In this case, the angle of inclination of the first inclined planes 28 and the second inclined planes 30 may be set at an angle corresponding to the outlines of the connector terminals 10*a* and 10*b*. Alternatively, the angle of inclination of the first inclined planes 28 and the second inclined planes 30 may be set at an angle corresponding to the gradients of the connector terminals 10*a* and 10*b*.

In this structure, at the insertion of the card, the terminal protecting member 14 is moved in accordance with the operation of inserting the plural-row-terminal card 8A (see FIG. 5C), each second connector terminal 10*b* is guided in the direction of moving away from the plural-row-terminal card 8A to retreat to the coated portion 14*p* by the first inclined plane 28 (see FIG. 5B) and, subsequently, each first connector terminal 10*a* is guided in the direction of moving away from the plural-row-terminal card 8A to retreat to the coated portion 14*p* by the first inclined plane 28. At this time, each second connector terminal 10*b* is moved from the second inclined plane 30 to the first inclined plane 28, in the through hole 14*a*, and is positioned on the coated portion 14*p* again.

When the plural-row-terminal card 8A is housed in the card housing portion 10*p*, the second connector terminals 10*b* elastically contact the second card terminals 8*b*, respectively, through the through hole 14*b*, and the first connector terminals 10*a* elastically contact the first card terminals 8*a*, respectively, through the through hole 14*a* (see FIG. 5A).

At the extraction of the card, the terminal protecting member 14 is moved in accordance with the operation of extracting the plural-row-terminal card 8A (see FIG. 5A), each first connector terminal 10*a* is guided in the direction of moving away from the plural-row-terminal card 8A by the second inclined plane 30 and is urged to retreat from the through hole 14*a* to the coated portion 14*p* (see FIG. 5B) and, subsequently, each second connector terminal 10*b* is guided in the direction of moving away from the plural-row-terminal card 8A by the second inclined plane 30 and is urged to retreat from the through hole 14*b* to the coated portion 14*p*.

When the plural-row-terminal card 8A is extracted from the card housing portion 10*p*, the connector terminals 10*a* and 10*b* are released from the terminal protecting member 14 and thereby return to the initial state by their own elastic force.

According to the present embodiment, as described above, the connector terminals 10*a* and 10*b* can be maintained in the state of being in no contact with the plural-row-terminal card 8A except the card terminals 8*a* and 8*b*, by providing the terminal protecting member 14 configured to move in accordance with the operations of inserting and extracting the plural-row-terminal card 8A, between the plural-row-terminal card 8A and the connector terminals 10*a* and 10*b*. Each of the connector terminals 10*a* and 10*b* can be thereby prevented from abutting or hitching on a stepped wall 8*g* (see FIG. 1B) at a boundary between the card terminals 8*a* and 8*b* and the surface 8*s* of the plural-row-terminal card 8A, when the card is inserted and extracted. Therefore, each of the connector terminals 10*a* and 10*b* can be prevented from being bent or buckled. As a result, use of the card connector 10 can be continued for a long time.

Furthermore, according to the present embodiment, since a mechanism to move the terminal protecting member 14 does not need to be additionally provided by integrating the terminal protecting member 14 with the eject lever 16, reduction of the number of components can be attempted accordingly. As a result, rise in the manufacturing costs of the card connector 10 can be suppressed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A card connector in which a card-shaped storage medium having a surface and a plurality of card terminals arranged in positions recessed from the surface is inserted so as to be extracted, the card connector comprising:

a card housing module in which the card-shaped storage medium is inserted;

a plurality of connector terminals provided in the card housing module and configured to contact the plurality of card terminals of the card-shaped storage medium; and a terminal protecting member provided in the card housing module and configured to move between the card-shaped storage medium and the plurality of connector terminals in accordance with operations of inserting and extracting the card-shaped storage medium, wherein the terminal protecting member comprises (i) coated portion configured to maintain the plurality of connector terminals in a state of being in no contact with the card-shaped storage medium while the card-shaped storage medium is inserted in the card housing module up to contact positions where the plurality of card terminals contact the plurality of connector terminals, (ii) a first inclined plane which guides the plurality of connector terminals in a direction of moving away from the card-shaped storage medium and urges the plurality of connector terminals to retreat to the coated portion when the card-shaped storage medium is inserted, and (iii) a second inclined plane which guides each of the plurality of connector terminals urged to retreat to the coated portion, toward the card-shaped storage medium, when the card-shaped storage medium is inserted, wherein the second inclined plane guides the plurality of connector terminals in the direction of moving away from the card-shaped storage medium and urges the plurality of connector terminals to retreat to the coated portion when the card-shaped storage medium is extracted, and the coated portion comprises through holes which intervene between the plurality of connector terminals and the plurality of card terminals and urge the plurality of connector terminals to contact the plurality of card terminals when the card-shaped storage medium is inserted in the contact positions of the card housing module.

2. The card connector of claim 1, further comprising a guide mechanism configured to guide the terminal protecting member along directions of inserting and extracting the card-shaped storage medium.

3. The card connector of claim 2, wherein the guide mechanism comprises an eject lever configured to move along the directions of inserting and extracting the card-shaped storage medium, and to urge the card-shaped storage medium to be ejected at the extraction, and the terminal protecting member is integrated with the eject lever.

4. The card connector of claim 1, wherein the first inclined plane is provided at a tip side of the terminal protecting member in the inserting direction, and the first inclined plane and the second inclined plane are provided to be opposite to each other, at the through hole of the terminal protecting member.

5. The card connector of claim 4, wherein the first inclined plane is positioned at a more upstream side in the inserting direction than the second inclined plane, at the through hole of the terminal protecting member.

6. An electronic apparatus comprising:

a housing; and a card connector which is provided inside the housing and in which a card-shaped storage medium having a surface and a plurality of card terminals arranged in positions recessed from the surface is inserted so as to be extracted, wherein the card connector comprises:

a card housing module in which the card-shaped storage medium is inserted;

a plurality of connector terminals provided in the card housing module and configured to contact the plurality of card terminals of the card-shaped storage medium; and a terminal protecting member provided in the card housing module and configured to move between the card-shaped storage medium and the plurality of connector terminals in accordance with operations of inserting and extracting the card-shaped storage medium, the terminal protecting member comprises (i) coated portion configured to maintain the plurality of connector terminals in a state of being in no contact with the card-shaped storage medium while the card-shaped storage medium is inserted in the card housing module up to contact positions where the plurality of card terminals contact the plurality of connector terminals, (ii) a first inclined plane which guides the plurality of connector terminals in a direction of moving away from the card-shaped storage medium and urges the plurality of connector terminals to retreat to the coated portion when the card-shaped storage medium is inserted, and (iii) a second inclined plane which guides each of the plurality of connector terminals urged to retreat to the coated portion, toward the card-shaped storage medium, when the card-shaped storage medium is inserted, wherein the second inclined plane guides the plurality of connector terminals in the direction of moving away from the card-shaped storage medium and urges the plurality of connector terminals to retreat to the coated portion when the card-shaped storage medium is extracted, and the coated portion comprises through holes which intervene between the plurality of connector terminals and the plurality of card terminals and urge the plurality of connector terminals to contact the plurality of card terminals when the card-shaped storage medium is inserted in the contact positions of the card housing module.

7. The apparatus of claim 6, further comprising a guide mechanism configured to guide the terminal protecting member along directions of inserting and extracting the card-shaped storage medium.

8. The apparatus of claim 7, wherein the guide mechanism comprises an eject lever configured to move along the directions of inserting and extracting the card-shaped storage medium, and to urge the card-shaped storage medium to be ejected at the extraction, and the terminal protecting member is integrated with the eject lever.

9. The apparatus of claim 6, wherein the first inclined plane is provided at a tip side of the terminal protecting member, in the inserting direction, and the first inclined plane and the second inclined plane are provided to be opposite to each other, at the through hole of the terminal protecting member.

10. The apparatus of claim 9, wherein the first inclined plane is positioned at a more upstream side in the inserting direction than the second inclined plane, at the through hole of the terminal protecting member.

11. An electronic apparatus comprising:

a housing; and a card connector provided inside the housing, the card connector comprises:

a card housing module for receipt of a card-shaped storage medium including a surface and a plurality of card terminals arranged in positions recessed from the surface, a plurality of connector terminals provided in the card housing module, the plurality of connector terminal being configured to contact the plurality of card terminals of the card-shaped storage medium, and a terminal protecting member provided in the card housing module and configured to move between the card-shaped storage medium and the plurality of connector terminals in accordance with operations of inserting and extracting the card-shaped storage medium, the terminal protecting member comprises (i) a coated portion configured to maintain the plurality of connector terminals in a state of being in no contact with the card-shaped storage medium while the card-shaped storage medium is inserted in the card housing module other with the plurality of card terminals, (ii) a first inclined plane which guides the plurality of connector terminals in a direction away from the card-shaped storage medium and urges the plurality of connector terminals to retreat to the coated portion when the card-shaped storage medium is inserted, and (iii) a second inclined plane which (a) guides each of the plurality of connector terminals urged to retreat to the coated portion toward the card-shaped storage medium, when the card-shaped storage medium is inserted, and (b) guides the plurality of connector terminals in the direction away from the card-shaped storage medium and urges the plurality of connector terminals to retreat to the coated portion when the card-shaped storage medium is extracted.

12. The apparatus of claim 11, wherein the coated portion comprises through holes which intervene between the plurality of connector terminals and the plurality of card terminals and urge the plurality of connector terminals to contact the plurality of card terminals when the card-shaped storage medium is inserted in the contact positions of the card housing module.

13. The apparatus of claim 11, further comprising a guide mechanism configured to guide the terminal protecting member along directions of inserting and extracting the card-shaped storage medium.

14. The apparatus of claim 13, wherein the guide mechanism comprises an eject lever configured to move along the directions of inserting and extracting the card-shaped storage medium, and to urge the card-shaped storage medium to be ejected at the extraction, and the terminal protecting member is integrated with the eject lever.

15. The apparatus of claim 11, wherein the first inclined plane is provided at a tip side of the terminal protecting member, in the inserting direction, and the first inclined plane and the second inclined plane are provided to be opposite to each other, at the through hole of the terminal protecting member.

16. The apparatus of claim 15, wherein the first inclined plane is positioned at a more upstream side in the inserting direction than the second inclined plane, at the through hole of the terminal protecting member.

* * * * *